US007086798B1

(12) United States Patent
Cetera

(10) Patent No.: US 7,086,798 B1
(45) Date of Patent: Aug. 8, 2006

(54) PEN WITH ADVERTISING MEANS

(75) Inventor: Carl Cetera, Tenafly, NJ (US)

(73) Assignee: Cotapaxi Custom Design and Manufacturing, LLC, Carlstadt, NJ (US)

( * ) Notice: Subject to any disclaimer, the term of this patent is extended or adjusted under 35 U.S.C. 154(b) by 0 days.

(21) Appl. No.: 11/096,983

(22) Filed: Mar. 31, 2005

(51) Int. Cl.
*B43K 29/00* (2006.01)

(52) U.S. Cl. ..... 401/195; 401/52; 401/6

(58) Field of Classification Search ..... 401/195, 401/52, 6; 24/11 R, 11 F, 11 HC
See application file for complete search history.

(56) References Cited

U.S. PATENT DOCUMENTS 1,607,894 A * 11/1926 Johnson ..... 24/11 F
4,787,161 A * 11/1988 Feng ..... 401/195
5,086,577 A 2/1992 Abernethy
6,299,372 B1 10/2001 Wang
6,332,247 B1 12/2001 Hsieh
6,450,721 B1 * 9/2002 D'Amico et al. ..... 401/195
6,702,499 B1 * 3/2004 Fang ..... 401/243

* cited by examiner

*Primary Examiner*—Khoa D. Huynh
(74) *Attorney, Agent, or Firm*—The Soni Law Firm

(57) ABSTRACT

A hand held implement and a clip intended for use on a hand held implement with the clip including graphical or imprinted material on a removable piece. The clip further includes a base plate upon which the removable piece is placed in typical construction and use and a transparent cover which is fitted onto the base plate to create a unitized assembly in which the removable piece is sandwiched between the base plate and cover. The removable piece may thereafter be quickly and easily replaced or modified to change, revise or otherwise update the imprinted material viewed through the transparent cover of the clip.

16 Claims, 1 Drawing Sheet

PEN WITH ADVERTISING MEANS

FIELD OF THE INVENTION

The present invention is directed to the field of hand held implements, and more specifically, to the use of such implements as a vehicle for advertising, promotion or other message conveyance. Examples of such implements would be writing implements, laser pointers, cutting implements and other small elongated hand implements.

BACKGROUND OF THE INVENTION

In the past, hand held implements have long been used as vehicles for the conveyance of a written or graphical message. Typically this message was for the purpose of advertising or promotion, but in other instances, the message may have contained information which was important to the user, such as perhaps reference tables or other frequently used information. Once imprinted on the implement, however, the message became "cast in stone" and incapable of being updated, changed or otherwise modified. Additionally, for practicality, the implements must be preprinted and as such, specific quantities of implements so designated, manufactured or otherwise selected.

Hand held implements with graphical or advertising material imprinted on the barrel or body are well known to any consumer, as perhaps the most common business promotional hand out item. Others have attempted to distinguish their inventions from the conventional imprinted products, by essentially changing the location of format of imprinting. For example, U.S. Pat. No. 5,086,577 to Abernathy discloses a secondary flag which sits atop the writing implement on a sleeve that extends upward from the cap. While that invention introduces a secondary element for locating the graphical content, its placement on an extension sleeve is highly susceptible to breakage and is clearly less desirable, as the flag is distracting, if not a hindrance to normal use of the implement.

Similarly, U.S. Pat. No. 6,299,372 to Wang discloses a writing implement which includes a visual display within its barrel. While this invention may permit the user to selectively change the display, such a change is only accomplished through a change of the barrel, as the lighted image is contained therein.

Finally, U.S. Pat. No. 6,332,247, to Hsieh discloses a two piece pen clip wherein the user selects or options the invention with a specific design on one part of the clip. This invention, however, does not suit the need for a readily interchangeable graphics clip, as the inserts must be of a specific style and shape, and can only be constructed of a configuration to slide onto the first "U" shaped clip wires. As a result, the amount of material which may be located on the graphics portion is very small and there can be no immediate change of such information, as the particular piece must be fabricated so as to fit onto the clip.

What is needed in this field is a hand held implement which facilitates rapid change of available graphical information which may exist in a variety of formats. It would be quite advantageous if the invention could be mass produced with appropriate graphical or promotional materials later added at the whim of manufacturer or user. Such an invention should also include the capability to continually and immediately update the graphical material, for example, to provide a monthly calendar or similar information.

SUMMARY OF THE INVENTION

An object of the present invention is to provide a hand held implement which incorporates a means by which advertising or graphical material may be included on the implement without the need for imprinting the material directly upon a surface of the implement.

Another object of the invention is to introduce a hand held implement on which any user may impart their own graphical or promotional material without the requisite printing, tools or complicated procedures presently known.

Yet another object of the present invention is to present a hand held implement on which graphical or printed material may be quickly and easily changed, modified or updated, again without the need of special tools or imprinting.

The present invention accomplishes these and other objectives by providing a hand held implement that includes multi-piece clip with the capability to quickly incorporate graphical or promotional material. The clip has a base mounting component, on which the graphical material resides. The graphical message or material may be imprinted directly upon the clip base, but in most cases, the material would be included on a secondary component, such as a small piece of paper or plastic, which is then rested upon the clip base.

A transparent cover is than fitted upon the base. This cover then encapsulates the graphical or advertising material to provide the clip as a unitized assembly, typically configured as part of a hand held implement. Should the manufacturer, user or other individual wish to change or modify the graphical material, the process is quite simple. One merely has to remove the cover and insert a new or modified secondary component and then reassemble the clip assembly.

The present invention thereby introduces a hand held implement which has the concurrent ability to readily change the advertising or graphical material for both newly manufactured or existing implement products made with the present invention's clip design. Examples of such implements contemplated within the scope of the present invention include writing implements such a pens and pencils, laser pointers, conventional pointers, cutting implements such as knives, awls and scribes, and other hand-held implements such as brushes, cosmetics applicators, soldering devices and computer styluses.

BRIEF DESCRIPTION OF THE DRAWINGS

These and other aspects of the invention will now be described with reference to the accompanying drawings, in which.

DETAILED DESCRIPTION OF THE INVENTION

The purpose of the present invention is to provide the user with a display of advertising or promotional material which can be readily inserted, changed or revised by any number of means and individuals. While the preferred embodiment is that of a pen, this invention is well suited to and applicable for any hand held implement. Examples of such implements contemplated within the scope of the present invention include writing implements such a pens and pencils, laser pointers, conventional pointers, cutting implements such as knives, awls and scribes, and other hand-held implements such as brushes, cosmetics applicators, soldering devices and computer styluses.

Figure 1:
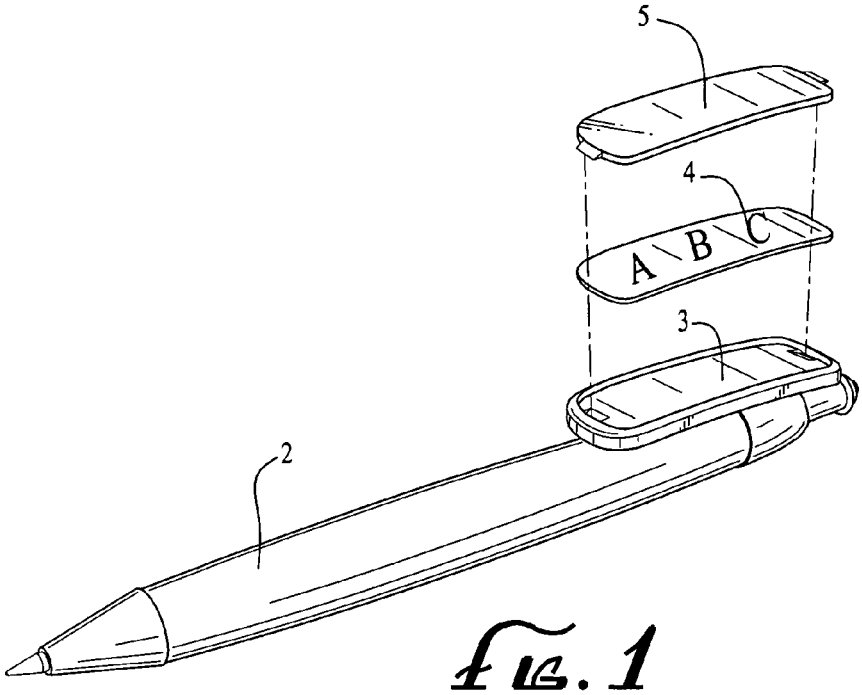
FIG. 1 illustrates an exploded view of a preferred embodiment of the hand held implement in the configuration of a pen, showing the base plate, graphical material and transparent cover.
Figure 2:
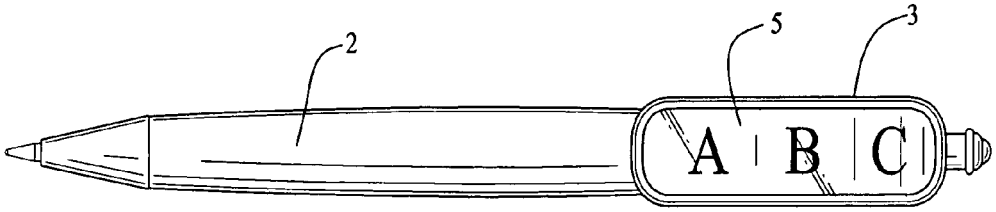
FIG. 2 illustrates a front view of a preferred embodiment of the hand held implement in the configuration of a pen, showing the base plate, graphical material and transparent cover as assembled on the hand held implement.
Figure 3:
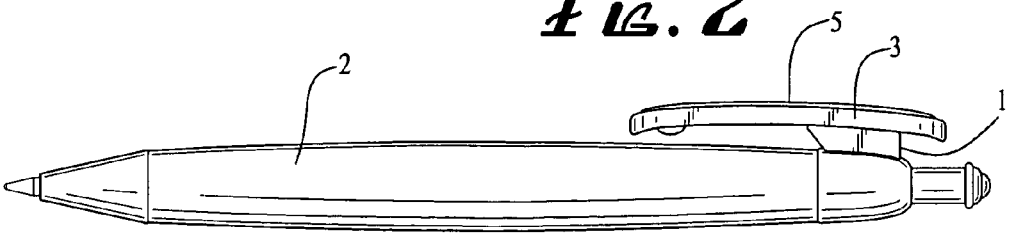
FIG. 3 illustrates a side view of a preferred embodiment of the hand held implement in the configuration of a pen, showing the base plate, graphical material and transparent cover as assembled on the hand held implement which is in the configuration of a conventional pen.

Referring to FIG. 1, the present invention includes a multi-piece clip which is attached to the main body of a hand held implement. The clip comprises an attachment or a ridge 1, by which it is attached to an implement body 2. The clip itself has a base plate 3, onto which a message 4 is placed. The message 4 is then encapsulated with the base plate 3, by means of a transparent cover 5. As shown in FIGS. 1, 2 and 3, in the preferred embodiment, the cover 5 is snap fitted onto the base plate 3 to create a unitized construction which sandwiches the message 4 between the base plate 3 and cover 5. The second base plate surface defines the ridge 1 extending generally perpendicularly from the second base plate surface. The ridge is adapted to define a gap between the second base plate surface and the implement when engaged thereto for selective securement of the implement to an article.

To change, update or otherwise modify the message 4, one need only remove the transparent cover 5 and replace or modify the message 4 and then reinstall the cover 5. In other embodiments, graphical or advertising material may be imprinted directly upon the base plate 3 and the message 4 may be omitted. Should the user thereafter wish to change the graphical material, the clip may be disassembled and a message 4 can be inserted prior to reassembly. Moreover, the message 4 may be constructed of a transparent substance, such that all or a portion of the imprinted material on the base plate 3 is visible through the cover 5 and message 4.

The message 4 may be constructed from a variety of materials, including, but not limited to, plastic, metal or paper. In fact, if the cover 5 is properly sealed to the base plate, a liquid could be inserted between the cover 5 and base plate 3. This would impart additional characteristics to the invention such as coloration, fluorescence, glow or other desirable visual effects.

What is claimed is:

1. A clip adapted to be used with a hand held implement comprising:

a generally flat first base plate surface;

a generally flat removable planar message piece sized and configured to be selectively disposable upon said first base plate surface;

a transparent cover sized and configured to be disposable upon said message piece, said cover further being adapted to be removably engaged to said first base plate surface when disposed upon said message piece;

a second base plate surface disposed opposite said first base plate surface, said second base plate surface defining a ridge extending generally perpendicularly from said second base plate surface, said ridge being adapted to define a gap between said second base plate surface and the implement when engaged thereto for selective securement of said implement to an article; and wherein said message piece is disposable upon said first base plate surface and said cover is disposable upon said message piece for providing a unitized clip assembly such that said message piece is visible.

2. The clip of claim 1, wherein said transparent cover is constructed of plastic.

3. The clip of claim 1, wherein said transparent cover is snap fitted onto said first base plate surface.

4. The clip of claim 1, wherein the wherein said clip assembly is adapted to be permanently attached to the body of said hand-held implement.

5. The clip of claim 1, wherein advertising or graphical material is depicted on said message piece for advertising and promotion.

6. The implement of claim 1, wherein advertising and promotional or graphical material is imprinted on at least one outer surface of the implement for the purpose of advertising or promotion.

7. An elongated handheld implement comprising:

an implement body having a first elongated end and a second end;

said first end having a clip;

said clip having a base plate with an outwardly facing surface, a generally flat removable message piece disposed upon said outwardly facing surface of said base plate, and a transparent cover sized and configured to be fitted upon the outwardly facing surface and said message piece to create a unitized clip assembly, said clip defining a ridge extending generally perpendicularly from a surface disposed opposite said outwardly facing surface of said base plate said ridge defining a gap between said base opposite surface of said plate and said implement body for selective securement of the implement to an article; and said second end being located opposite the first end and further including a tip.

8. The implement of claim 7 wherein the tip is retractable.

9. The implement of claim 7, wherein said hand-held implement is selected from the group consisting of a writing instrument, a laser pointer, a stylus pen, a multi-function writing instrument, a screwdriver, and a tire pressure gauge.

10. The implement of claim 7, wherein the first end further includes a stylus tip.

11. The implement of claim 7, wherein the second end further includes a stylus tip.

12. The implement of claim 7, wherein the transparent cover is constructed of plastic.

13. The implement of claim 7, wherein the transparent cover is snap fitted onto the flat outwardly facing surface.

14. The implement of claim 7, wherein the wherein said clip assembly is permanently attached to the body of said hand-held implement.

15. The implement of claim 7, wherein advertising or graphical material is depicted on the planar piece, said advertising being viewable when the hand-held implement for writing or marking is within the user's garment pocket, is clasped to an anchoring point, or in the user's hand.

16. A method of advertising or promotion whereby advertising or graphical material is imprinted upon at least one outer surface of an elongated handheld implement having:

an implement body having a first elongated end and a second end;

said first end having a clip, said clip having a base plate with an outwardly facing surface, a generally flat removable message piece disposed upon said outwardly facing surface of said base plate, and a transparent cover sized and configured to be fitted upon the outwardly facing surface and said message piece to create a unitized clip assembly;

said clip defining a ridge extending generally perpendicularly from a surface disposed opposite said outwardly facing surface of said base plate said ridge defining a gap between said base opposing surface of said plate and said implement body for selective securement of the implement to an article; and said second end being located opposite the first end and further including a tip.

* * * * *